US006474238B1

(12) United States Patent
Weinraub

(10) Patent No.: US 6,474,238 B1
(45) Date of Patent: Nov. 5, 2002

(54) GUN TRIGGER LOCK

(75) Inventor: Adam S. Weinraub, Orange, CA (US)

(73) Assignee: Weinraub Enterprises, Inc., Orange, CA (US)

( * ) Notice: Subject to any disclaimer, the term of this patent is extended or adjusted under 35 U.S.C. 154(b) by 0 days.

(21) Appl. No.: 09/593,533

(22) Filed: Jun. 14, 2000

(51) Int. Cl.[7] ..... F41A 17/54
(52) U.S. Cl. ..... 102/70.07
(58) Field of Search ..... 42/70.06, 70.07

(56) References Cited

U.S. PATENT DOCUMENTS 2,664,658 A * 1/1954 Bjorklund
3,392,471 A * 7/1968 Foote
3,624,945 A 12/1971 Foote
3,956,842 A 5/1976 Ballenger
4,030,221 A 6/1977 Doobenen et al.
4,499,681 A 2/1985 Bako et al.
4,509,281 A 4/1985 Dreiling et al.
5,153,360 A 10/1992 Upton
5,191,158 A 3/1993 Fuller et al.
5,392,552 A * 2/1995 McCarthy et al.
5,400,538 A * 3/1995 Shannon
5,437,119 A 8/1995 Womack
5,487,234 A * 1/1996 Dragon
5,515,633 A * 5/1996 Harris
5,535,605 A * 7/1996 Werner
5,544,440 A * 8/1996 Stockman
5,638,627 A * 6/1997 Klein et al.
5,899,102 A * 5/1999 Ling
5,918,402 A * 7/1999 Weinraub

* cited by examiner

*Primary Examiner*—Michael J. Carone
*Assistant Examiner*—Troy Chambers
(74) *Attorney, Agent, or Firm*—Harold L. Jackson

(57) ABSTRACT

A trigger locking safety device is disclosed having two side blocks, one of the side blocks having a locking pin affixed thereto. The locking pin is inserted into a hole in the other side block and the pin is held therein by a latch structure affixed to the end of a key lock tumbler rotatably located in that side block. Spacers inserted onto the pin take up the space between the side blocks and mate appropriately with a gun trigger guard and trigger to block the trigger from movement. Different spacers can be provided to conform with different trigger guard and trigger arrangements, allowing one side block and locking pin arrangement to be useable with a variety of gun types.

9 Claims, 5 Drawing Sheets

GUN TRIGGER LOCK

FIELD OF THE INVENTION

This invention relates generally to a firearm safety lock apparatus, and more particularly, to a trigger blocking structure for rendering a firearm inoperable by unauthorized persons such as adolescents and children.

BACKGROUND OF THE INVENTION

Thousand of handguns, shotguns and rifles are purchased every year by citizens for use in sporting events, such as hunting or trap and skeet shooting, or for use in home protection. Typically, guns are stored at one's home or apartment in drawers, closets or even under the bed. While a minority of gun owners have gun safes to store their guns, most guns owners store their guns in unlocked areas of the home accessible to others dwelling there. As such, guns provide a danger to children or adolescents whose curiosity may lead them to find and play with a gun. While adults may believe that guns are safely put away, children and adolescents always seem to find them, and as a result, fatalities and injuries resulting from the accidental discharge of firearms, particularly by children, has become problematic. In response to this rise of this danger, the U.S. Congress and many state legislative bodies throughout the country are considering enacting legislation requiring that each new purchaser of a gun be accompanied by the purchase of a suitable lock.

Conventional gun locking devices typically clamp around the trigger guard of the gun to prevent access to the trigger, such as the devices shown in U.S. Pat. No. 5,191,158 "Trigger Guard for a Firearm", U.S. Pat. No. 4,499,681 "Security Device for Firearms", U.S. Pat. No. 4,509,281 "Gun Trigger Lock" and U.S. Pat. No. 3,624,945 "Universal Self-Conforming Trigger Lock for Firearms". Other conventional gun locking devices are designed to immobilize the trigger as illustrated in U.S. Pat. No. 5,153,360 "Gun Lock". Some gun lock devices have been developed without key locking arrangements to allow quick access to the gun by adults but rendered safe against children who may gain access to the gun, such as disclosed in U.S. Pat. No. 4,030,221 "Gun Lock Using Manual Pressure" and U.S. Pat. No. 5,437,119 "Gun Trigger Blocking Structure" assigned to the assignee of the present invention.

Many of these prior art gun locking devices are constructed to fit only one type of gun, and therefore with the variety of guns available today, lack versatility needed to meet consumer demands. Other gun locking devices, while providing some versatility, have complex structural arrangements with a significant number of parts adding to complexity and cost of the gun lock. For example, U.S. Pat. No. 3,624,945 discloses a trigger lock with two complementary side elements which are compressed together around the gun trigger guard by a complex internal ratchet lever locking mechanism in the locking assemblage. The side elements carry a plurality of spaced-apart yieldable plungers in proximity to the trigger and guard to prevent shifting or movement of the lock assembly. Another rather complex arrangement is illustrated in U.S. Pat. No. 4,499,681 which discloses a fire arm security device with a pair of opposed trigger guard covers, one of the covers having an elongate protruding housing containing a latching portion of a latch member and the other cover formed with an opening in which is disposed a catch member adapted to engage and retain the latching portion when the covers are pressed together. The latch member may be moved out of engagement with the catch member to release the covers by means of a manual actuator which is controlled by a combination lock contained in the cover.

These described gun lock devices require a significant number of parts including complex key locking and latching arrangements. A reliable gun locking arrangement that has less parts and that is easy and cost effective to manufacture, yet provides simplicity and versatility would be an advancement in the gun locking art. It would further be an advantage in the art to provide a gun locking device that can be applied to a number of different types of guns and can be readily removed by an authorized user, but reliably prevents unauthorized use by children or adolescents. The present invention provides such a device.

SUMMARY OF THE INVENTION

It is therefore an object of this invention to provide a gun trigger blocking device that prevents access to the trigger of a gun when the gun is not in use.

Another object of the invention is to provide such a gun trigger blocking device that is adaptable to a variety of handguns, rifles or shotguns.

A further object of is to provide a gun trigger blocking device with few parts that is simple to manufacture, and easy for the user to assemble to a gun.

Still another object is to provide a gun trigger blocking device that prevents tampering by children and adolescents, protecting them from injury to themselves or others.

The invention broadly provides a gun locking arrangement for preventing unauthorized use of a firearm, including two opposed side block halves, one of the side block halves having a latch pin, and the other side block half having a hole for receiving the end portion of the latch pin and further having a latching arrangement for clasping onto the end of the latch pin to hold the side block halves in fixed spaced apart relationship. Plastic or rubber spacers or gaskets placed on the inside of the side block halves take up any space between the side block halves and the trigger guard. At least one of the spacers may include one or more tabs or protrusions which extend inwardly about the trigger or trigger guard to inhibit the trigger from moving. One or more spacers can be used on each side of the trigger guard depending on the particular gun being locked. As an alternative to the use of the spacers to block movement of the trigger dowel, pins selectively positioned between the side blocks may be used to prevent trigger movement.

Additional features of the invention may include a key lock cylinder arrangement mounted in the side block halves for receiving the latch pin, which key lock cylinder arrangement has a pivotal post at one end thereof. The end portion of the latch pin has a post retaining means for receiving and holding the post when key lock cylinder arrangement is turned to its locked position thereby locking the latch pin in the hole of the side block. By rotating the key lock cylinder arrangement to its unlocked position, the post releases the end portion of the latch pin allowing the latch pin to be withdrawn from the hole and the side block halves to be removed from the firearm.

The device is simple to apply to and remove from a gun, but affords reliable security against use of the gun by unauthorized individuals. The plastic spacers also provide a versatile trigger lock that is adaptable to trigger guards and triggers of various shapes, sizes and arrangements providing applicability to a variety of gun types.

The construction and operation of preferred embodiments of a gun trigger blocking device of the present invention may best be understood by reference to the following description taken in conjunction with the accompanying drawings in which like components are designated by the same primed or double primed reference numbers.

DESCRIPTION OF THE PREFERRED EMBODIMENTS

Figure 1:
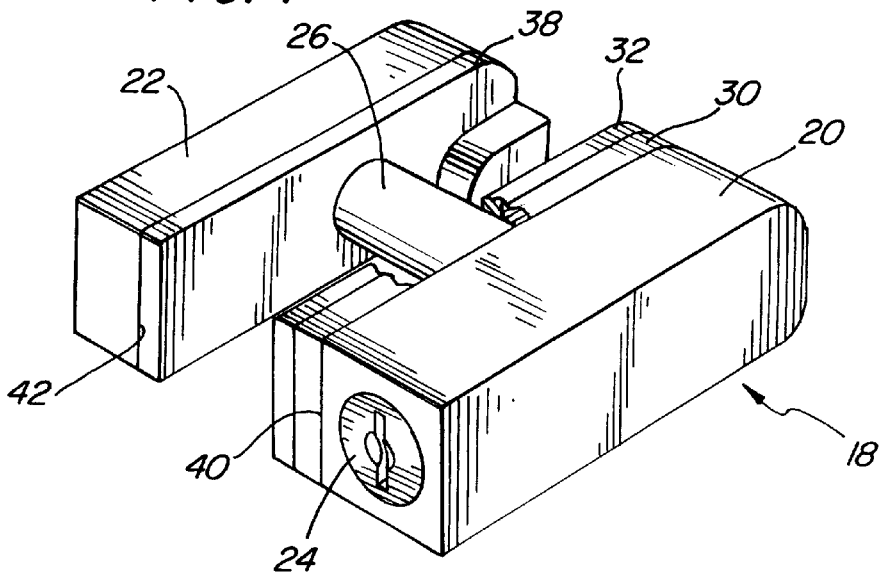
FIG. 1 is a perspective view of the assembled gun trigger blocking device in accordance with the principles of the invention.
Figure 2:
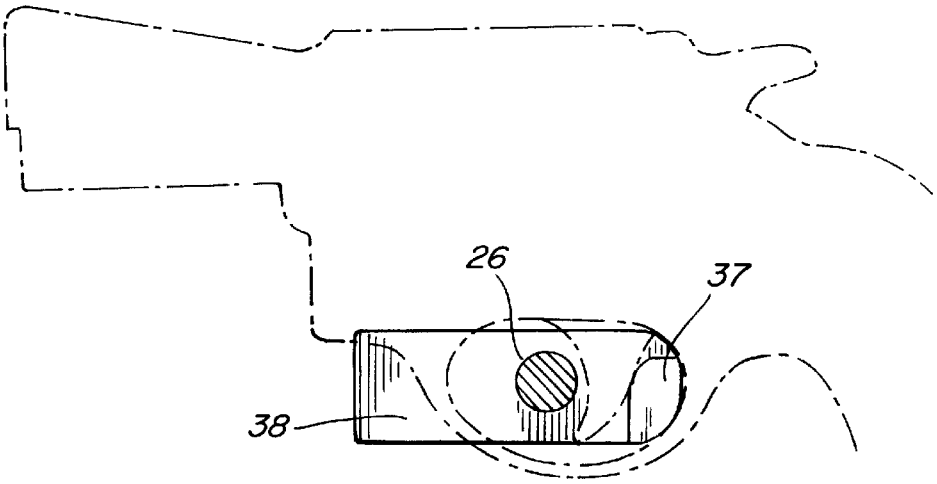
FIG. 2 is a diagrammatic view of the gun trigger blocking device secured around the trigger of a revolver (shown in phantom) with a trigger movement blocking latch pin and tab for preventing forward and rearward movement of the trigger.

Referring now to the drawings and more particularity to FIG. 1, there is shown a preferred embodiment of the gun trigger blocking device 18 in accordance with the principles of the invention including first and second body members or side block halves 20 and 22, respectively, in assembled condition. The side block halves are typically made of a metal material such as aluminum which is easily cast or machined yet strong and durable. The first body member 20 has a conventional key lock cylinder or tumbler 24 disposed therein. A locking latch pin 26 is mounted in the second body member 22 and received in a hole 28 (see FIG. 3) in the first body member 20. Two spacers or gaskets 30 and 32 are seated on the inner surface 40 of first body member 20, while a single spacer 38 is seated on the inner surface 42 of the second body member 22. While three spacer are shown in this embodiment, any number of spacers from two spacers or more can be used, which will depend on the trigger guard and trigger arrangement of the particular gun. The spacers seat over the trigger guard and trigger of a gun to block access to the trigger and/or hold the trigger in place as shown in FIG. 2. In FIG. 2, a tab 37 on the spacer 38 seats behind the trigger and on the trigger guard blocking rearward movement of the trigger. The locking latch pin 26 also inhibits access to the trigger.

The spacers are typically made of a plastic material, such as neoprene, which is sufficiently strong to prevent tampering with the trigger but will not mar the gun or its finish. The spacers are typically similarly sized in length and width to match the extent of the inner surface of the side block halves but may vary in thickness depending upon the particular geometry of the gun to be locked. Furthermore, additional spacers can be easily added to the pin to take up more space if needed. Advantageously, the one pair of side blocks and pin can accommodate a variety of different guns with the space between the side blocks being taken up by spacers of varying numbers and/or thickness.

Figure 3:
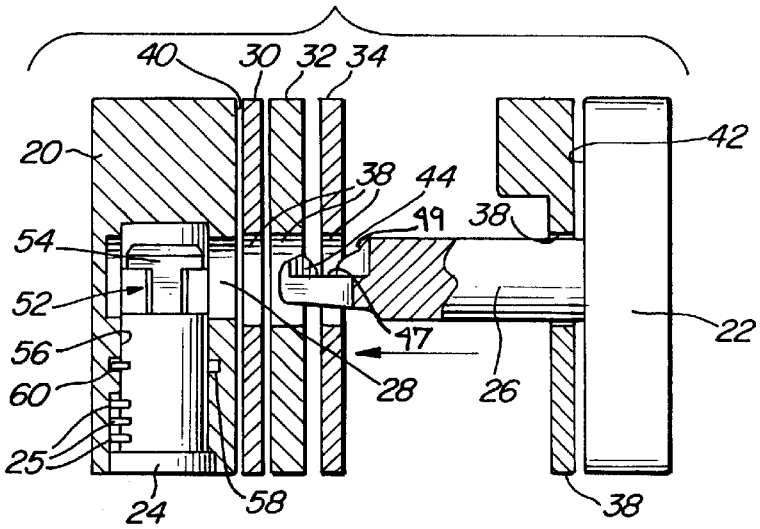
FIG. 3 is an exploded (partially assembled) view of both body members (or side block halves) and four spacers elements of the gun trigger blocking device similar to FIG. 1, shown partially in section.
Figure 3A:
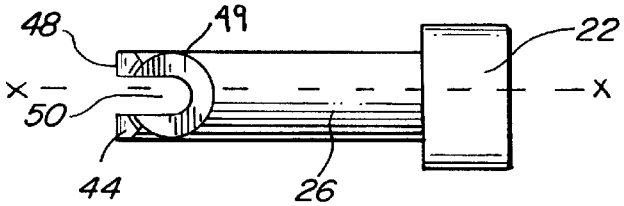
FIG. 3*a* is a view of the body member with latch pin in FIG. 2, rotated 90 degrees to show its latching portion.
Figure 4:
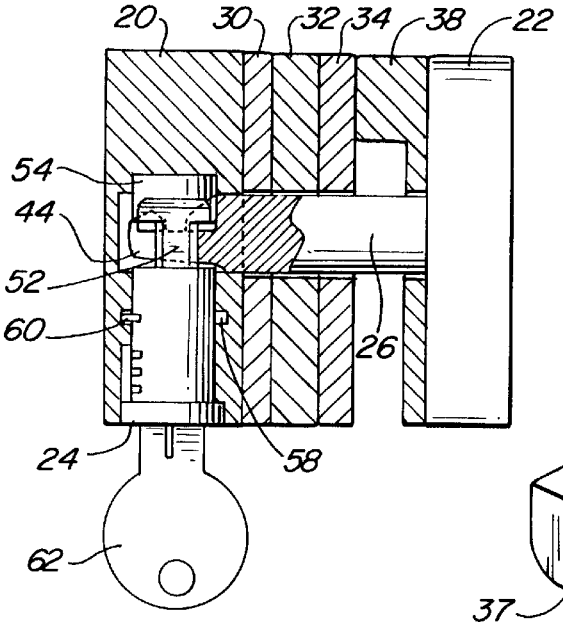
FIG. 4 is a view of the gun trigger blocking device, similar to FIG. 3, in assembled condition with the key inserted in the cylinder lock and the cylinder in its unlocked position.

As shown in FIG. 3, the four spacers or gaskets 30–36 illustrated in this figure have holes 38 through which the locking latch pin 26 is inserted. Hole 38 are sized so that the plastic spacers seat snugly on the pin. In this particular embodiment, three spacers 30–34 are seated against the first body member 20 and one spacer 36 is seated against the second body member 22. The locking latch pin 26 further extends through hole 28 in first body member 20. The distal end of the pin is provided with a latch structure or latch means which in this particular embodiment takes the form of two latch wings 44 and 48, also shown in FIG. 3*a*, which wings have an elongated V-shaped opening or slot 50 therebetween. The latch pin 26 defines a longitudinal axis x—x as shown in FIG. 3. A lateral groove 47 is formed between the high points of the wings 47, 48 and the portion 49 of the pin adjacent the proximal end of the slot as shown. FIG. 4 shows the locking latch pin 26 fully inserted into the hole 28 of the first body member 20. The latch wings are slidably inserted around post 52 which extends out of and along the longitudinal axis of the tumbler 24. On the post 52 is a T-portion 54 which is shown in FIG. 4 as rotated to align with the elongated opening 50.

In the locked position, the side blocks 20 and 22 are held in a fixed spaced apart relationship, i.e., a predetermined distance apart. The spacers such as 30, 32, 34 and 38 fill in any gaps between the blocking sides 20, 22 and the side of the trigger guard of the gun.

The key lock cylinder or tumbler 24 is mounted in a cylindrical stepped bore 56. This bore 56 has a groove 58 which receives a spring biased tumbler pin 60 thereby holding the tumbler in the stepped bore 56. A key, which withdraws the tumbler pin 60, when inserted into the key lock, may be used during the manufacturing process to initially insert the key lock cylinder into the bore 56. Once the key is withdrawn, the tumbler pin 60 moves outwardly into the groove 58 to maintain the key lock in place. The tumbler also carries a plurality of transverse tumbler pins 25 (FIG. 3) which actuate upon inserting the proper key to allow the cylinder lock to turn. The tumbler 24 may be turned within the bore 56, from its unlocked position (first angular position) illustrated in FIG. 4, through an angle of 90 degrees to its locked position (second angular position) illustrated in FIG. 5, by means of key 62. Once the tumbler is in its locked position, the key 62 may be removed from the tumbler.

Figure 6:
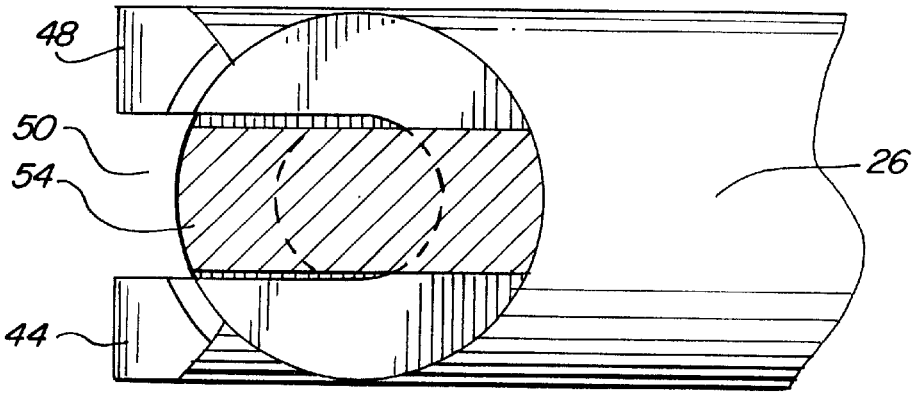
FIG. 6 is an enlarged view of the end of the latch pin with the latching post rotated to release the latch pin.
Figure 7:
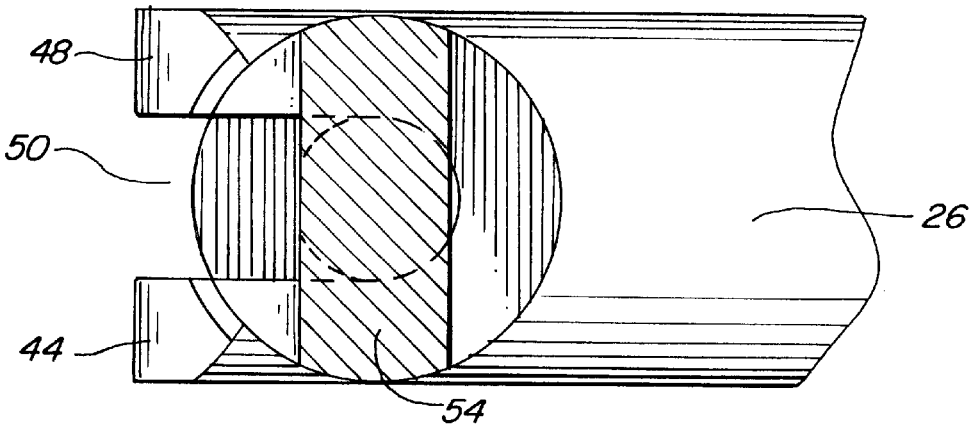
FIG. 7 is an enlarged view of the end of the latch pin with the latching post rotated to block withdrawal of the latch pin.
Figure 5:
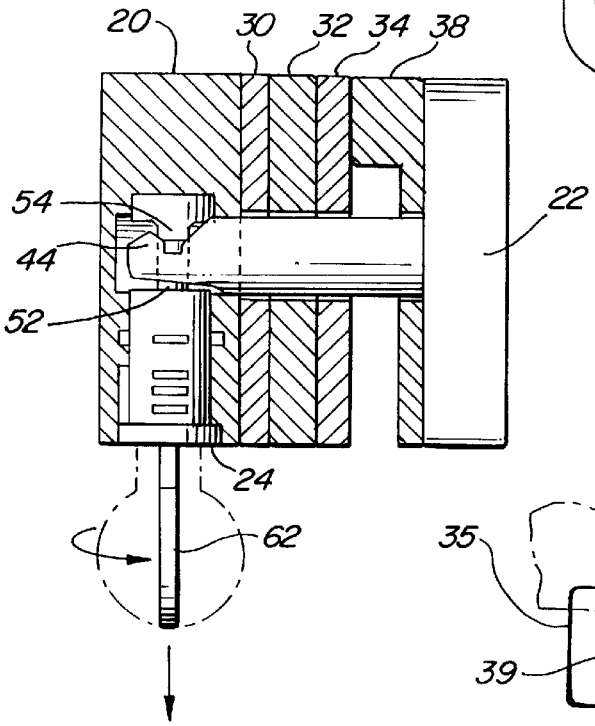
FIG. 5 is a view of the gun trigger blocking device with the key turning the cylinder to engage the latching post over the latch portion of the latch pin thereby locking the device.

As can readily be seen in FIG. 5, when the key is rotated to turn the tumbler, the post 52 on the end of the tumbler is rotated 90 degrees such that its T-portion 54 swivels to block the latch wings 44 and 48 and thus withdrawal of the locking latch pin 26. The latching arrangement is shown with more particularity in FIGS. 6 and 7. In FIG. 6, the post 52 seats in the slotted opening 50 with the T-portion 54 aligned with the slotted opening. The post and its T-portion is sized and shaped to slide between the two latch wings 44 and 48 in this position. In FIG. 7, the tumbler 24 is rotated to turn the post and its T-portion perpendicular to the slotted opening and the longitudinal axis of the locking latch pin, thereby in front of the latch wings 44 and 48, effectively blocking the T-portion. The locking latch pin is therefore blocked from movement and withdrawal.

Figure 8:
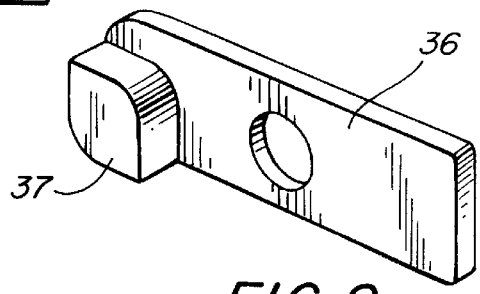
FIG. 8 is a perspective view of one of the spacer elements with a tab for blocking rearward movement of a trigger.
Figure 9:
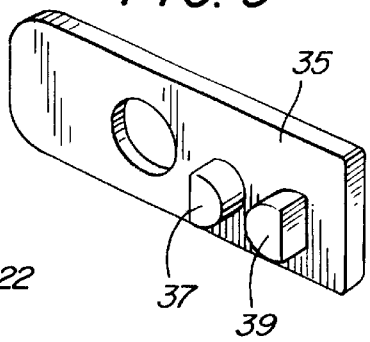
FIG. 9 is a perspective view of another spacer element with tabs for grasping a trigger guard of a gun.
Figure 10:
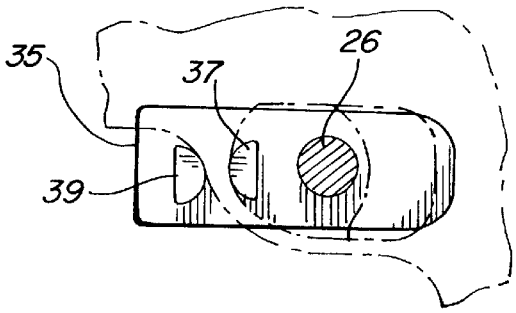
FIG. 10 is diagrammatic view of the gun trigger blocking device secured around the trigger of a revolver (shown in phantom) with the spacer element tabs (shown in FIG. 9) grasping the trigger guard and latch pin preventing movement of the trigger.

A variety of spacers are possible to accommodate different trigger guard and trigger arrangements. FIGS. 8 and 9 illustrate two such spacers. In FIG. 8, spacer 36 has a hole 38 for slidable inserting the spacer over a locking latch pin and against one of the side block halves. This spacer 36 is essentially flat with a tab protrusions or nub portion 37 at one end which is shaped and sized to sit behind a trigger within the trigger guard to keep the trigger from moving rearwardly. This spacer is shown assembled in the trigger lock of FIG. 1 and FIG. 2. The spacer 35 in FIG. 9 has two opposed tabs or nubs 37 and 39 which in operation receive a trigger guard of a gun (shown in phantom) in FIG. 10. The side block halves with the spacers along with the locking latch pin shown in FIG. 10 block access to the trigger of the gun.

Figure 11:
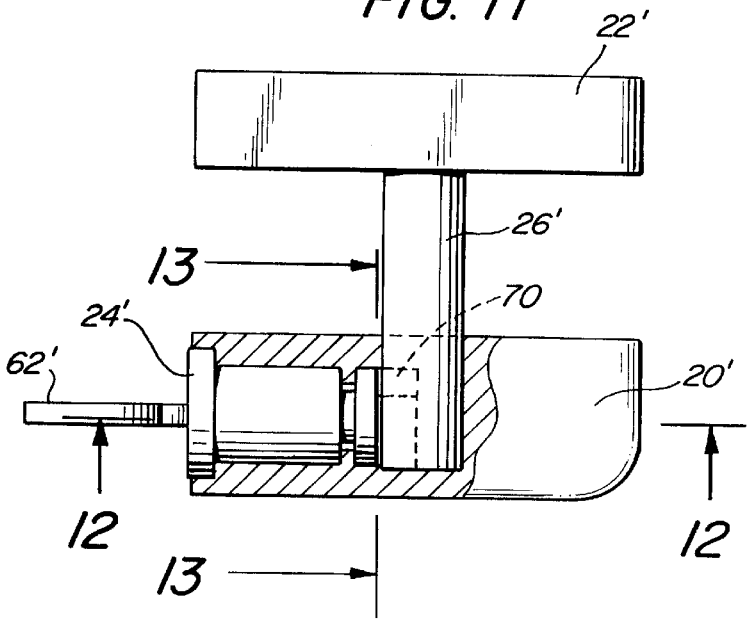
FIG. 11 is a top view of the body members shown partially in section, illustrating another preferred embodiment of a latching arrangement.
Figure 12:
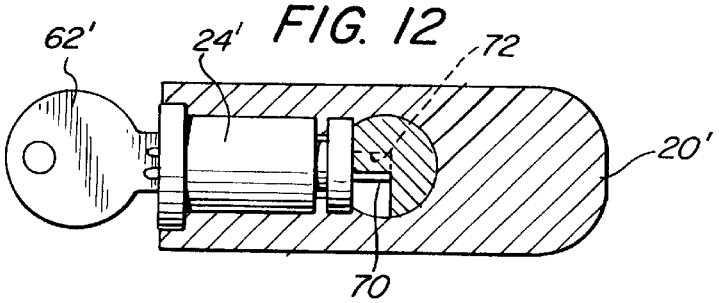
FIG. 12 is a side sectional view of one of the body members taken along lines 12—12 of FIG. 11, showing the key and lock cylinder rotated in position to secure the latch pin in one of the body members.
Figure 13:
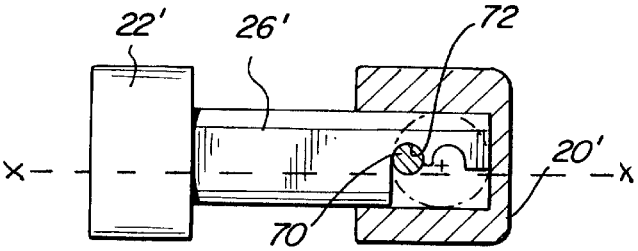
FIG. 13 is a partial cross-sectional view looking along lines 13—13 of FIG. 11, showing the cylinder lock latching tab engaging the latch pin securing the latch pin in the body member.
Figure 14:
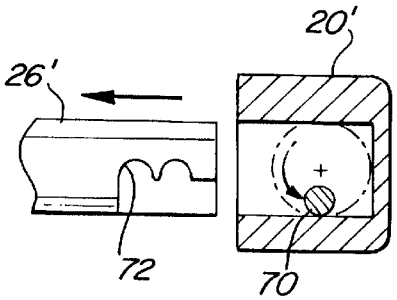
FIG. 14 shows the cylinder latching tab rotated 90 degrees thereby disengaging the latch pin for removal.
Figure 15:
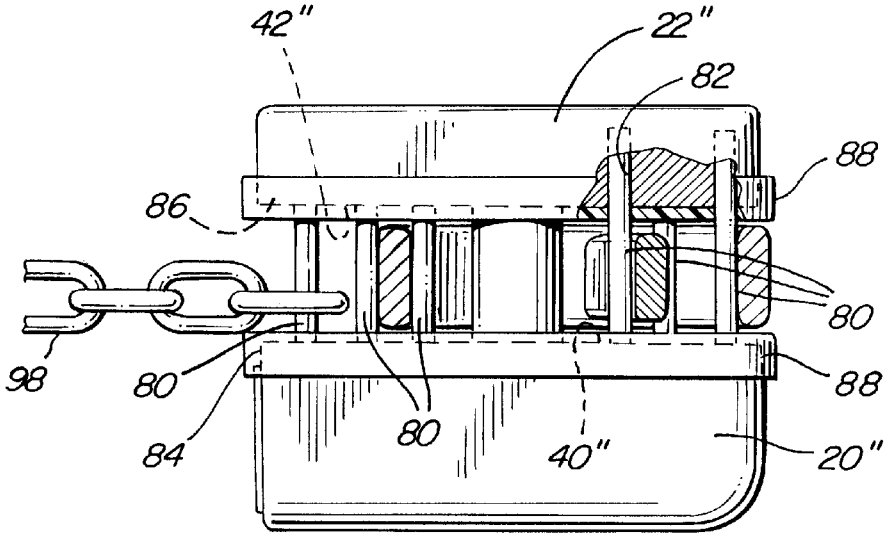
FIG. 15 is a partially broken away and sectional bottom view of a gun trigger blocking device secured around the trigger of a gun showing dowel pins positioned for securing the trigger and trigger guard in fixed position between the block halves.
Figure 16:
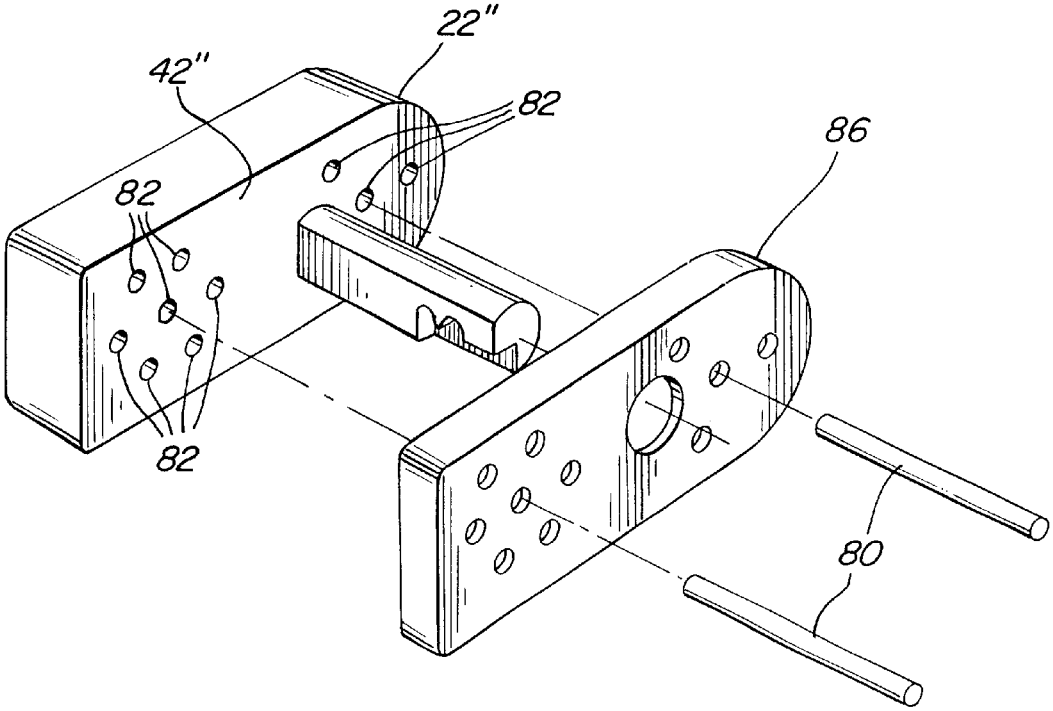
FIG. 16 is an exploded view of one of the block halves, showing its plastic side cover and two dowel pins for insertion into the block half.

FIGS. 11–14 illustrate another preferred embodiment of the latch pin and tumbler locking arrangement for the gun trigger blocking device. In FIG. 11, the first body member 20' has the conventional key lock cylinder 24' and the second body member 22' carries the latch pin 26'. The locking latch pin 26' extends into the first body member 20' with the key 62' and tumbler 24' shown in the locked position (second angular position). In this locked position, offset tab or peg 70 on the end of the tumbler 24' seats in transverse groove 72 located on the distal end of the locking latch pin 26'. When seated in the groove, the offset tab prevents movement of the locking latch pin as shown with more particularity in FIGS. 12 and 13. FIG. 14 illustrates the tumbler 24' turned from its locked position (FIG. 13) through an angle of 90 degrees to its unlocked position (first angular position), which is accomplished by means of turning key 62. This rotates offset tab 70 out of groove 72, and accordingly, the locking latch pin 26' can be removed from the first body member.

As an alternative to the spacers or gaskets described hereinabove, dowel pins 80, made of steel, for example, may be selectively positioned in various pin holes 82 in one of the side block halves 22" and seat up against the inner side 40" of the other side block 20". In order to accommodate different widths of trigger guards and to protect the gun from marring, plastic side pads or covers 84 and 86 are positioned over the inner sides 40" and 42" of the block halves 20" and 22", which side covers are held more securely in place by lips 88 which extend over the inner edges of the side block halves. Side covers 84 and 86 each have a plurality of pin holes 90, matched to the pin holes in side block half 22". It should be noted that additional pads or covers may be used to accommodate very wide trigger guards. The dowel pins 80 can be positioned about the gun trigger to prevent trigger movement and to aid in positioning of the gun trigger blocking device relative to the trigger and trigger finger guard. Sufficient pin holes 82 may be provided in the block half 22" (and side covers 84 and 86) to provide an adequate range of placement of the dowel pins 80 to suit a variety of guns with different trigger guard and trigger arrangements. As an additional security device, a security chain or cable 98, connected to one of the dowel pins 80, extends to solid connection with a fixed in place fixture (detail not shown) to deter theft of the gun.

There has thus been described an improved gun trigger locking device that is simple yet versatile. The novel gun locking device requires few parts thus saving manufacturing costs. Various modifications to the gun trigger locking device will occur to persons skilled in the art without involving any departure from the spirit and scope of the invention as set forth in the appended claims.

What is claimed is:

1. A gun trigger blocking apparatus for mounting on the trigger guard of a gun for inhibiting access to the trigger, comprising:

a first body member adapted to be mounted on one side of a trigger guard and having a locking latch pin extending therefrom, the latch pin defining a longitudinal axis and having at least one lateral groove at a right angle to the longitudinal axis on the distal end thereof;

a second body member adapted to be mounted on the other side of the trigger guard having a hole for receiving the latch pin when the body members are mounted on opposite sides of the trigger guard;

a cylinder lock rotatably mounted in the second body member for rotation through about a ninety degree angle between a locked to an unlocked position, the cylinder lock having only a single protruding post for axially rotating with the cylinder lock tumbler, the protruding post being arranged to extend within the groove on the latch pin in the locked position to prevent the body members from being separated and to be free of the groove in the unlocked position so that the latch pin may be removed from or inserted into the hole in the second body member.

2. The invention of claim 1 wherein the groove is semi-cylindrical and the protruding post is cylindrical.

3. The invention of claim 2 wherein said at least one groove comprises two grooves.

4. The invention of claim 2 wherein the cylinder lock extends at a right angle to the latch pin.

5. The invention of claim 1 wherein the latch pin includes a slot in the distal end thereof and the groove extends on one side of the slot and wherein the post is arranged to pass through the slot in the unlocked position and to extend into the groove when the cylinder lock is rotated to the locked position.

6. The invention of claim 5 wherein the post is in the form of a T-shaped member with two outwardly extending latch wings, the latch wings being arranged to pass through the slot in the latch pin when the cylinder lock is in the unlocked position and to extend into the groove when the body members are mounted on a trigger guard with the cylinder lock in the lock position.

7. The invention of claim 1 wherein the at least one spacer member has a protruding block-shaped nub extending behind the trigger sized and shaped to inhibit rearward movement of the trigger.

8. In invention of claim 7 wherein the at least one spacer member has two opposed block-shaped numbs for grasping the trigger guard therebetween.

9. The invention of claim 1 further including at least one resilient spacer member mounted on an inner surface of one of the side members for substantially taking up the space between the inner surface of the side members and the trigger guard or trigger when the side members are locked together.

* * * * *